US005170743A

United States Patent [19]

Zimmer

[11] Patent Number: 5,170,743

[45] Date of Patent: * Dec. 15, 1992

[54] DOCTOR BLADE DEVICE FOR APPLYING, AND SCRAPING OFF, OR FOR DOSED APPLICATION OF FLOWABLE AND SPREADABLE SUBSTANCES

[76] Inventor: Joahannes Zimmer, Ebentalerstr. 133, A-9020 Klagenfurt, Austria

[ * ] Notice: The portion of the term of this patent subsequent to May 1, 2007 has been disclaimed.

[21] Appl. No.: 635,123

[22] PCT Filed: Jul. 4, 1990

[86] PCT No.: PCT/AT90/00066

§ 371 Date: Mar. 5, 1991

§ 102(e) Date: Mar. 5, 1991

[87] PCT Pub. No.: WO91/00779

PCT Pub. Date: Jan. 24, 1991

[30] Foreign Application Priority Data

Jul. 6, 1989 [AT] Austria ..... 1649/89

[51] Int. Cl.[5] ..... B05C 11/02

[52] U.S. Cl. ..... 118/119; 118/126; 118/413; 118/414; 118/419

[58] Field of Search ..... 118/406, 414, 419, 119, 118/212, 213, 248, 126, 413; 101/119, 120

[56] References Cited

U.S. PATENT DOCUMENTS

| | | | |
|---|---|---|---|
| 3,029,779 | 4/1962 | Hornbostel | 118/119 |
| 3,084,663 | 4/1963 | Warner | 118/118 |
| 4,658,753 | 4/1987 | Eklund | 118/119 |
| 4,920,914 | 5/1990 | Zimmer | 118/419 |
| 4,993,352 | 2/1991 | Zimmer | 118/414 |

FOREIGN PATENT DOCUMENTS

| | | | |
|---|---|---|---|
| 0311728 | 4/1989 | European Pat. Off. . | |
| 0311730 | 4/1989 | European Pat. Off. . | |
| 0311745 | 4/1989 | European Pat. Off. . | |
| 2034004 | 9/1978 | Fed. Rep. of Germany . | |
| 2901830 | 8/1979 | Fed. Rep. of Germany . | |
| 387188 | 12/1988 | Fed. Rep. of Germany . | |
| 389676 | 1/1990 | Fed. Rep. of Germany . | |
| 2219006 | 9/1974 | France . | |
| 88675 | 2/1958 | Switzerland | 118/119 |

*Primary Examiner*—Michael G. Wityshyn
*Attorney, Agent, or Firm*—Herbert Dubno

[57] ABSTRACT

A doctor blade device has a magnetically-operated roller or a cylindrical rod enclosed in a sectional bar which does not influence the application process. The sectional bar surrounds this roller like a sleeve bearing and the sectional bar is pivotable around the axis of the application roller.

8 Claims, 2 Drawing Sheets

DOCTOR BLADE DEVICE FOR APPLYING, AND SCRAPING OFF, OR FOR DOSED APPLICATION OF FLOWABLE AND SPREADABLE SUBSTANCES

CROSS REFERENCE TO RELATED APPLICATIONS

This application is a national phase of PCT/AT90/00066 filed Jul. 4, 1990, and based upon Austrian national application A 1649/89 filed Jul. 6, 1989, under the International Convention.

1. Field of the Invention

The invention relates, to a doctor blade device and as well as to a process using this doctor blade device.

2. Background of the Invention

A large number of processes of various kinds are known for applying flowable substances to or scraping flowable substances from flat surfaces, e.g. transfer surfaces. The processes include spreading processes, coating processes using doctor rollers, applications with dosing rollers or applications by extrusion through nozzle slots.

SUMMARY OF THE INVENTION

The invention comprises a doctor blade device for applying, applying and scraping off, or for the metered application of flowable and spreadable substances, optionally with the use of a stencil, on preferably moving webs of material or other flat surfaces with variable amounts to be applied by means of a roller acting under magnetic pressure (directly or indirectly acting magnetic pressure) or by means of a cylindrical rod, whereby this application roller, or cylindrical rod cooperates with a sectional bar co-influencing the application process.

According to the invention the sectional bar co-influencing the application process is mounted on the application roller or the cylindrical rod or is connected therewith and surrounds it like a sleeve bearing basically over its entire length and in any case over the area of the respective application width and covers a large portion of the shell surface of roller or of the cylindrical rod. The sectional bar is rotatable about the axis of the application roller or the cylindrical rod.

In short, the device of the invention consists in providing two main working components or namely an application roller, cylindrical rod and a sectional bar surrounding the cylindrical rod like a sleeve bearing and provided with a surface suited for application. The two components are connected to each other through an opening shaped like a sleeve bearing so that operationally the assembly is almost a single-component articulated structure.

A large quantitative and qualitative variability results, as well as precise, accurately reproducible, automated control capability of the application process, and at the same time an applicability to the most varied substrates and with various coating substances. It is also possible, depending on the substrate, substance and final product, to achieve an in-depth application, such as impregnation, or a less penetrating application of the substance or merely a sparse superficial coating covering the entire surface of the substrate, so that the substrate can have an application surface with a novel appearance and which is modified from the point of view of weight and value increase, with improved utility. With the new process technique, the thickness of the applied layer can range for instance from 0.5 mm to 1.0 mm.

Each application process can be generally broken down approximately into the following individual process steps:

(a) Supply of the substance with a surplus or with excessive pressure either directly onto the substrate or to the application device, (b) performing at least one step in order to meter the amount to be applied (amount of coating per surface unit), (c) performing at least one step in order to achieve the best possible uniformity of application over the entire application width, and (d) the actual transfer process.

A particularly advantageous characteristic of the new process technique according to the invention is that when devices produced for this process are used, the previously described four discrete process steps (a) to (d) become so variable and mutually attuned, that with one and the same technique of the invention, application device built according to the invention, a large variety of coating substances of very different viscosities in very different amounts can be applied uniformly to a great variety of substrates of any desired width.

It is particularly advantageous that, as mentioned before, within a widely variable application range, it is possible to set precisely the required quantities and type of substance application required by the respective coating process and to keep it constant thereafter even when the process technique or the production kind requires changes in the application or web speed.

Besides, the application devices according to the invention are extraordinarily simple to handle. Furthermore, the application devices according to the invention offer optimal premises for the mechanization and automation of all aforedescribed technical process components which quantitatively and qualitatively influence the coating process.

Due to this type of application, it is possible to produce on a very thin, on a very inexpensive or on a surface structure (substrate) having a certain resistance, a certain physical property—e.g. a conglutination capability—a quasi novel product of a certain completely different nature and having a different aspect, completely different from the supporting substrate. It is also conceivable or possible to perform the process so that a layer-forming substance applied to a substance-repellant support surface is fixed by a process step such as polymerization, following immediately after the application, and then finally removed from the substance application surface required by the coating process as an independent and subsequently usable final or intermediate product.

Another application possibility, which is very different from the above-described use according to the invention is the application in connection with flat or cylindrical stencils or cylindrical screens. This is the case when between the substrate surface coating device resting thereagainst thereagainst resting coating device produced according to the invention, a flat or a cylindrical stencil, or an open screen or a cylindrical screen is inserted. This possible use of the device is further proof of the extremely versatile applicability and of the advantageous results of the characteristic features of the invention.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
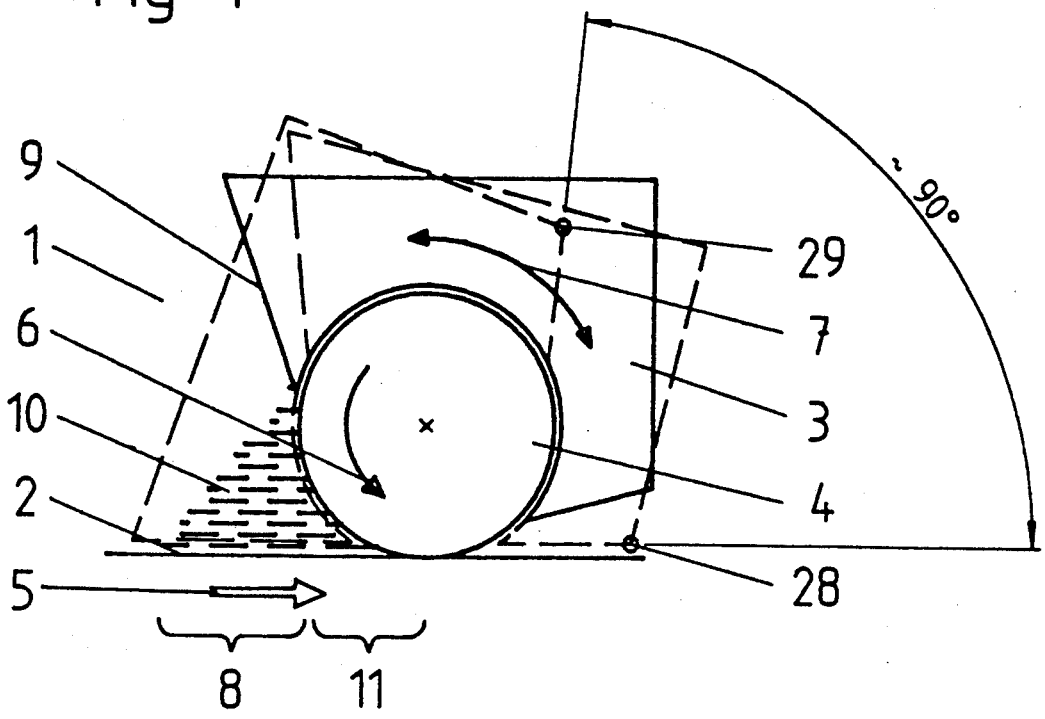
FIGS. 1 and 2 are diagrammatically sectional views which show an embodiment in two different positions.
Figure 2:
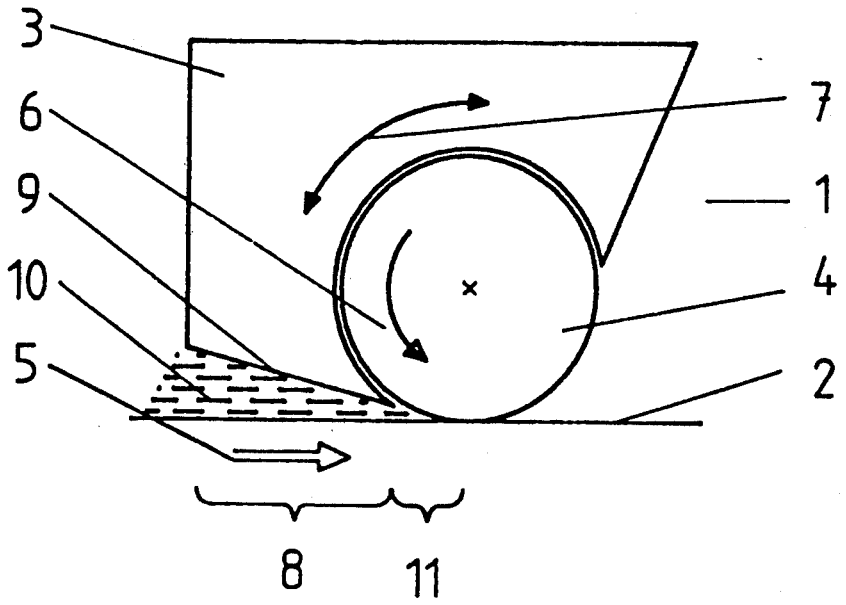

FIGS. 1 and 2 each show an application device 1 according to the invention in its simplest construction, without mounting and swivel devices, resting against a flat surface to be coated 2 and consisting of the sectional pivot bar 3 arranged on an application roller 4. The arrow 5 shows the travel direction of the surface to be coated. It is also conceivable that the surface 2 to be coated is fixed and that the application device 1 is rolled upon the surface 2 to be coated in a direction opposite to the one indicated by arrow 5.

The travel direction indicated by arrow 6 is the same in both afore-described travel variants of the device, and so is the swivel motion and its effect in the process of the sectional bar around the axis of the application roller 4 indicated by arrow 7.

This swivel motion of the sectional bar 3 causes a change in the pressure of the substance application in the substance contact area 8 (equal substance contact time interval) in the area upstream of the transfer, respectively removal process.

The surface 9 is rotated concentrically to the application roller 4, i.e. about this roller, respectively around the axis of the application roller 4.

Of utmost importance is the very large swivel range of the surface 9 in comparison to the heretofore known swivellable doctor blade devices. In FIG. 1, the swivel range through the two end positions of the sectional bar 3 is indicated in a broken line and it can be 5° to 100°. Preferably it amounts to approximately 90°. The reference numerals 29 and 28 reproduce a corresponding point of the sectional bar in the two positions. It has to be pointed out that, although it is advantageous when the sectional bar 3 surrounds the application roller 4 by two thirds, other proportions are also possible. However given the case, instead of the slide-on connection another type of connection has to be used, e.g. connection rods, a connection by weight load or axle end pivot, or also by magnetically caused attraction of the two components.

The rotated position of the sectional bar 3 shown in solid lines in FIG. 1 exerts a very slight pressure (practically almost zero) on the bank of the coating substance 10 located in the area ahead of or upstream of the roller 4 underneath the substance application surface 9.

The rotated position of the sectional bar 3 shown in FIG. 2 causes the application surface 9 to exert a very high pressure on the application substance 10. Here it has to be additionally explained that the size of this substance-application pressure is also influenced by the viscosity and nature of the substance to be applied and by the speed of the application.

For the supply of the substance to the application device, which supply is not shown in the drawing, there are various possibilities, whereby it is also conceivable to limit the substance contact area 8 in a direction contrary to the direction of the arrow 5. In this way, a further increase of the dynamic pressure of the substance can be achieved.

The arrangement of an application device according to the invention represented in FIG. 2 illustrates the device, as well as the successive process steps according to the invention. Due to the magnetic source not illustrated in this FIG. 2, the device 1, i.e. the application roller 4 and the sectional bar 3 mounted onto it, i.e. both components working together as a single-component device, are pressed uniformly against the application surface 2, over its entire length extending in axial direction. Underneath the sectional accumulation surface 9 of the area 8 and the bordering area 11 of the application roller 4 the actual application area controlling quantitatively and qualitatively the application effect is created and it consists of the two component areas 8 and 11.

When the doctor blade device of the invention is used, the application process can be controlled through the following parameters. Length and shape (i.e. straight, curved, stepped) of the application surface 9, angular position, i.e. inclination of the application surface 9 with respect to the application surface 2, height of the gap range, respectively the distance between the application surface 9 and application surface 2 in the application area 8 and in the application area 11. Further, the gap range between application roller 4 and application surface 2, respectively table surface, conveyor belt or the like supporting the web to be coated, which applies when the material to be applied is compressable. The adjustment of the gap range takes place through:

(a) Adjustment of the magnetic pressure, by taking into consideration the substance viscosity and the setting of the already mentioned parameters and (b) by selecting the diameter of the application roller and of course the operating speed is also an important criterium.

A further important criterium is the relationship between the area extension length 8 of the application surface 9 and the diameter of the application roller 4. It is possible to combine a relatively long surface 9 with a relatively small roller diameter, or also a relatively short surface 9 with a relatively large roller diameter. The longer the surface 9, the narrower the gap set between the 9 and 2 and the higher the viscosity and the web speed, the stronger is the pressure exerted on the substance by the surface 9 in the area 8 against the web 2 and with an equal force (i.e. counterforce) the application roller 4 is relieved of pressure.

Figure 3:
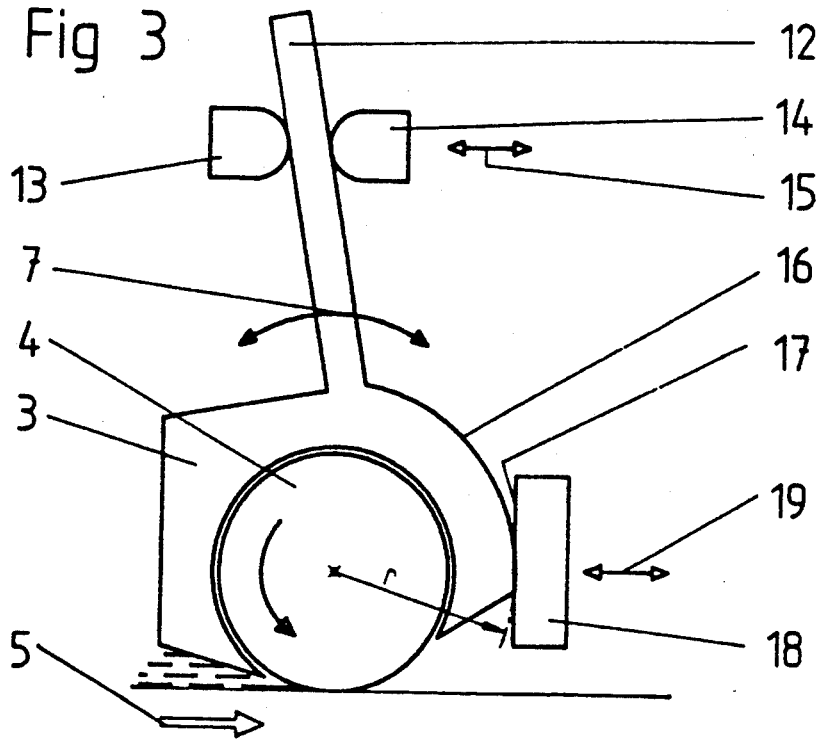
FIGS. 3 and 4 are diagrammatic sectional views which show further embodiments of the invention.

Due to the cooperation according to the invention of the aforementioned parameters, a higher application pressure is generated in the gap area 8 where there is no contact with the device than in any other case known to the state of the art, because at an optimal setting of the amounts to be applied, the edge zone of the application surface 9 (clearly shown in the area 11 in FIG. 2) still does not touch the application surface 2 when acting as a scraping blade and because—as just was explained—the application roller 4 is supported relieved of weight, but without being capable of changing its position, since the application roller is held and encompassed by the sectional rod 3 and the sectional rod 3 rests against the auxiliary device 18 in the embodiment of FIG. 3.

As clearly shown in the figures, the individual component steps of the application process are the following: (a) the feeding of the substance to be applied and the start of the substance/substrate contact take place in the area in front of the application device, a fact which is not shown in the figures; as a result of the next process step (b), the metering (first of all the dosage of the amount) controlling the quantitative and qualitative parameters of the application process are performed in the application zone formed by the path segments 8 and 11. Thereby it is of utmost technological importance that, while carrying out their application function, the two elements 3 and 4 of the device act as a device with a single-component construction and that due to the rotation of the component 3 a control of the application parameters and their adjustment to the process become possible. Hereby, a fact of great importance to be considered is that this rotation creates the surface pressure force of the substance application surface 9 against the application surface 2 or against the substance 10 between these two surfaces, thus exerting a force upon the application roller 4 relieving its pressure against the surface 2, which in turn results in a further effect on the qualitative, respectively quantitative application parameters.

It is possible to bring the application device built and adjusted according to the invention to operate close to the limit of "floating on the surface" of the application surface 2 or a substance layer 10 gliding through underneath the support area of the application roller 4. In such a setting, it is possible to create novel application effects which have not been possible according to the state of the art, since in the heretofore-known application processes and devices an increasing substance application pressure always corresponded to a proportionally increased doctor blade pressure. It also has to be mentioned by comparison that in the application devices with rollers built according to the state of tee art and used in the heretofore-known processes, the above-mentioned phenomenon of "floating on the surface" is extremely undesirable, since it causes operational failure and application irregularities.

An additional feature of the invention relating to the above-described application process and device techniques consists in the fact that the application element 4 can be selected at will to be either a rotating roller or a nonrotatable cylindrical spreading rod. Furthermore, in the application device built according to the invention it is even possible to make the process and device selection between an application with rotating roller or an application with a nonrotatble roller or cylindrical rod—even while the device is operating.

A further feature of the invention is the possibility to connect the application roller 4 with a drive not shown in the drawing, whereby the drive can be set to be synchronized, to trail or to lead. This results in a further parameter for the quantitative and qualitative control of the application process.

The process step (c) takes place according to the path segment or the time interval at the point or the moment when at the end of the path segment 11 the contact between the application element 4 and the application surface 2 is established.

The measure which is extremely important for the application process within the general course of this process is the uniform distribution of substance over the entire application width or the length of the application device and it is carried out—as a second working function—by the surface 9 of the sectional bar 3 due to the same combination, i.e. the functional connection of the aforedescribed acting manner of the surface 9 with the surface shell of the application element 4 touched by the substance, whereby, as already described, the substance application pressure is generated.

The last component step of the process (d) takes place at the path segment where the path area 11 is ending and the application element 4 is pressed by magnetic force over its entire length or its entire application width—against the substrate or application surface 2 or a stencil located therebetween. The uniformity of this pressure over the entire length of the application device, respectively over the entire application width, resulting from the way specific to the invention in which this pressure is generated, is also an important factor in finalizing the even distribution over the entire width in the path segments 8 and 11.

An additional characteristic feature of the invention aiming at a precise metering of the amounts to be applied per surface unit is achieved due a certain structure of the shell surface of the application roller 4 or the thereagainst pressed apex area of the cylindrical rod 4. The surface can for instance be smooth, rough or ribbed, or in the shell surface of the application roller 4 a shallow-cup or grid-like structure can be devised. In this case, the volume of such recesses in the surface of the application roller 4, or cylindrical rod play a part in determining the resulting applied amounts.

Figure 4:
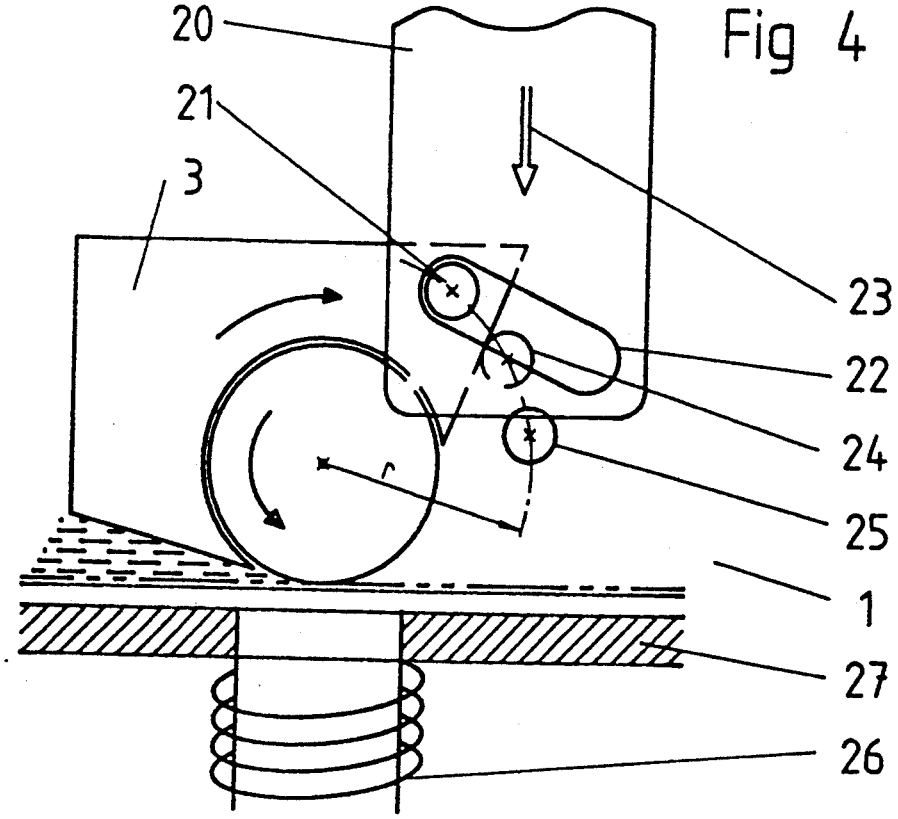

In FIGS. 3 and 4, two variants of the mounting and adjusting arrangements of the application device are shown.

FIG. 3 shows a possible construction of the sectional swivel bar 3 with at least one part 12 through which the swivel motion 7 is induced by a regulating device in the application device, respectively transmitted to the sectional swivel bar 3. The regulating parts 13, 14 causing the swivel motion 7 can be moved rectilinearly in the direction of the arrow 15 so that the rectilinear motion 15 is converted into a swivel motion 7 by the device 13, 14.

However, it is also conceivable that the swivel motion 7 can be executed by a regulating device making a swivel motion. The surface 16 of the sectional swivel bar 3 is rounded. However, this rounding could be limited only to a portion of the bar 3 or it could be located on a separate component connected with bar 3.

The essential aspect in this additional characteristic feature of the invention resides in the fact that this rounded portion is concentric to the axis of the application roller, respectively the sectional bar 4 and that this rounded surface 16 concentric with the swivel axis rests against a surface 17 of the buffer component 18, which can be displaced in the direction of the arrow 19, if necessary. It is possible to limit the application device in direction of arrow 5 (travel direction) for instance by means of a centrally located component 18. It is also possible to limit the advance possibilities of the application device and also to insure its parallel positioning by means of for instance two components similar to 18, each located in the end areas of the application device.

In FIG. 4 a mounting and at the same time swivel actuating component 20 is represented, which is mounted vertically movable at both ends of the application device 1. The application device is held and guided in an inclined recess 22 of the component 20, by means of a pivot 21 attached to both ends of the sectional bar 3. In FIG. 4, the pivot 21 is located in the upper area of the recess 22.

When the component 20 is moved downwardly in the direction of arrow 23, the pivot 21 reaches first the median area of the recess 22, respectively in the position 24 shown in broken lines. When the components 20 continue to move in the direction 23, finally the lower area of the recess 22, respectively the position 25 is reached. In FIG. 4 there is also a magnetic source 26, which was not shown in FIGS. 1 to 3 and which is connected with the working table 27.

Instead of being in the component 20, the recess 22 can be provided in the sectional bar 3 or in another component rigidly connected with this bar. Logically in this case the pin, bolt or the like would no longer be attached to the sectional bar 3, but to the component 20.

Instead of this embodiment of a magnetic source 26, 27 shown in FIG. 4, also other embodiments are conceivable, such as a magnetic roller. But it is also conceivable to use instead of a magnetic roller or a magnetic device 26, 27 a common roller of magnetizable steel, with the sectional bar 3 or the roller 4 or both these elements being magnetically active and exerting magnetic pressure on the steel roller.

The magnetic source establishes the position for the doctor blade device according to the invention, namely also in the operational state, besides it presses the doctor blade device to the extent required by the working function of the application.

In the case of large application widths or length, it is also possible to make the sectional bars 3 of a bending-slack material and to adjust the doctor blade 4 thereto.

I claim:

1. A coating apparatus comprising:

a support for a material to be coated;

a doctor blade device juxtaposed with said support and provided upstream thereof with a bank of substance to be coated onto said material, said doctor blade device comprising a cylindrical doctor element pressed against said material and having an axis, and a sectional bar partly surrounding said element and having a cylindrical surface closely juxtaposed with said element over substantially two-thirds of the circumference thereof, said bar receiving said element like a sleeve bearing over substantially the entire length of said element and being rotatable about said axis, said bar having an application surface swingable through an angle of substantially 5° to 100° relative to said support and defining with said material a variable angle through which said substance is pressed as said device and said material are moved relatively to coat said substance onto said material with said device;

means operatively connected with said bar for varying the angle included between said application surface and said material; and means for pressing said device against said material and said support.

2. The apparatus defined in claim 1 wherein said element is a nonrotatable cylindrical rod.

3. The apparatus defined in claim 1 wherein said element is a rotatable cylindrical roller.

4. The apparatus defined in claim 1 wherein at least one of said element and said bar contain a magnetically attractable metal and said means for pressing said device against said material is at least one magnetic field source.

5. The apparatus defined in claim 1 wherein said application surface is a planar surface.

6. The apparatus defined in claim 1 wherein said means for varying the angle included between said application surface and said material includes a device capable of rectilinear displacement and means for converting said rectilinear displacement into angular displacement of said bar about said axis.

7. The apparatus defined in claim 1 wherein said bar forms one of a plurality of bars of various shapes, widths and application surface configurations, said bars being interchangeably mounted on said element.

8. The apparatus defined in claim 1 wherein said bar has a rounded surface at a downstream side of said device and said apparatus further comprises a member braced against said rounded surface of said bar.

* * * * *